US008464386B2

(12) United States Patent
Garcia

(10) Patent No.: US 8,464,386 B2
(45) Date of Patent: Jun. 18, 2013

(54) FLOOR CLEANING APPARATUS WITH INTEGRATED DISPENSING AND CONTAINMENT ROLLS

(76) Inventor: Fernando Garcia, Oswego, IL (US)

( * ) Notice: Subject to any disclaimer, the term of this patent is extended or adjusted under 35 U.S.C. 154(b) by 0 days.

(21) Appl. No.: 13/310,124

(22) Filed: Dec. 2, 2011

(65) Prior Publication Data

US 2012/0167918 A1 Jul. 5, 2012

Related U.S. Application Data

(63) Continuation-in-part of application No. 12/984,930, filed on Jan. 5, 2011.

(51) Int. Cl.
*B08B 1/04* (2006.01)

(52) U.S. Cl.
USPC ..... 15/99; 15/98

(58) Field of Classification Search
USPC ..... 15/98, 99, 228, 231
See application file for complete search history.

(56) References Cited

U.S. PATENT DOCUMENTS

| | | | | |
|---|---|---|---|---|
| 2,079,452 | A | 5/1937 | Hunter | |
| 2,153,686 | A | 4/1939 | Deegan, Sr. | |
| 2,452,744 | A | 11/1948 | Gardner | |
| 3,072,941 | A | 1/1963 | McMaster | |
| 4,510,642 | A | 4/1985 | Ingermann et al. | |
| 4,550,467 | A | 11/1985 | Johnson et al. | |
| 5,327,609 | A * | 7/1994 | Bierma et al. | 15/98 |
| 6,032,318 | A | 3/2000 | McLaughlin et al. | |
| 6,405,403 | B1 | 6/2002 | McKay | |
| 6,741,054 | B2 | 5/2004 | Koselka et al. | |
| 7,811,649 | B2 | 10/2010 | Post | |
| 2009/0158542 | A1 | 6/2009 | Noble | |

* cited by examiner

*Primary Examiner* — Shay Karls
(74) *Attorney, Agent, or Firm* — Reinhart Boerner Van Deuren P.C.

(57) ABSTRACT

A floor cleaning apparatus is provided. The floor cleaning apparatus includes a roller arrangement for carrying rolls of soiled and unsoiled cleaning media thereon. The floor cleaning apparatus also includes an actuation arrangement operable to simultaneously unwind unsoiled cleaning media and wind soiled cleaning media.

8 Claims, 8 Drawing Sheets

FLOOR CLEANING APPARATUS WITH INTEGRATED DISPENSING AND CONTAINMENT ROLLS

CROSS-REFERENCE TO RELATED PATENT APPLICATIONS

This patent application is a continuation-in-part of co-pending U.S. patent application Ser. No. 12/984,930, filed Jan. 5, 2011, the entire teachings and disclosure of which are incorporated herein by reference thereto.

FIELD OF THE INVENTION

This invention generally relates to floor cleaning devices and particularly to manual floor cleaning devices used to clean hard flooring.

BACKGROUND OF THE INVENTION

Floor cleaning devices such as mops and the like are well known. These devices typically incorporate a fibrous or sponge head used to introduce a water/chemical cleaning solution onto a hard floor. The head is also responsible for collecting dirt and other particles, and for scrubbing away surface stains. Despite the mop's long standing effectiveness in cleaning hard floor surfaces, there have been several problems identified with the above configuration.

As one example, mops typically require a bucket and squeegee mechanism for carrying the water/chemical cleaning solution, and for straining the fibrous mop head to ensure a consistent amount of the solution is introduced to the floor. The bucket and squeegee mechanism is somewhat cumbersome, and can lead to large amounts of water/chemical cleaning solution spillage as the mop is taken to and from the bucket. Further, the head must be continuously refreshed with clean water/chemical cleaning solution.

As another example, the fibrous mop head quickly collects dirt and other particles and can become very unsightly. Further, collection of dirt and other particles within the mop head can create an unsanitary condition as the mop sits in storage. Additionally, the mop head has a tendency to produce an odor over time.

As a result of the generally unpleasant look/smell and unsanitary state of the fibrous mop head, frequent replacement is generally required. Unfortunately, conventional mop heads are typically made of stranded fabric or sponge material and frequent replacement can be uneconomical. As a result, several recent devices have entered the market to alleviate the above problems.

One example of such a device incorporates a removable pad that is affixed to a base frame. The removable pad can be supplied pre-impregnated with cleaning solution. The pads are designed for single use, or several uses, and once they are dirty the user simply removes the pad, and replaces it with a new pad. The pads tend to be relative inexpensive, and as such, these products have become a viable alternative to conventional mops. However, the above mentioned devices are not without drawbacks.

For example, it is generally accepted that the pads must be frequently replaced so that the device incorporating the pad maintains its cleaning efficacy. This frequent replacement can lead to a less than desirable cost in utilizing the device, and indeed can ultimately lead to the same cost inefficiency as conventional fibrous mop heads.

Furthermore, as stated above, the pads often times are supplied pre-impregnated with a chemical solution. Thus, the type of solution is generally governed by the manufacturer of the pads, leaving the consumer constrained to several options. However, many users may wish to use less abrasive chemicals, or may simply wish to use only waters. Unfortunately, users of the above devices must currently choose from those options supplied by the manufacturer.

In view of the above, there is a need in the art for an improved floor cleaning apparatus that alleviates the above noted problems. The invention provides such an apparatus. These and other advantages of the invention, as well as additional inventive features, will be apparent from the description of the invention provided herein.

BRIEF SUMMARY OF THE INVENTION

In one aspect, embodiments of the invention provide a floor cleaning apparatus configured to simultaneously unwind unsoiled cleaning media and wind soiled cleaning media so that the unsoiled cleaning media can be introduced to a surface being cleaned at a users discretion. The floor cleaning apparatus according to this embodiment includes a frame. A dispensing roller is mounted to the frame. The dispensing roller is adapted to carry a roll of cleaning media thereon. A collection roller is also mounted to the frame. The collection roller is adapted to collect the cleaning media from the dispensing roller. The floor cleaning apparatus also includes an actuation mechanism carried by the frame. The actuation arrangement is connected between the dispensing roller and the collection roller and operable to simultaneously rotate the dispensing roller and the collection to advance the cleaning media from the dispensing roller to the collection roller.

In another aspect, the dispensing roller and the collection roller rotate at the same speed as one another to maintain a constant tension in the cleaning media extending between the dispensing roller and the collection roller.

In another aspect, the floor cleaning apparatus further includes a first and a second pair of roller grips. The first pair of roller grips is mounted on the dispensing roller for rotation therewith. The second pair of roller grips is mounted on the collection roller for rotation therewith. Each of the first and second pairs of roller grips are positioned to axially compress the roll of cleaning media. In certain embodiments, the first and second pairs of roller grips are mounted on the dispensing and collection rollers, respectively, such that the cleaning media carried on the dispensing and collection rollers does not rotate relative to the dispensing and collection rollers.

In another embodiment, the frame includes a bottom wall defining the cleaning surface and a pair of side walls extending upwardly therefrom in opposed spaced relation. The dispensing and collection rollers are mounted to the pair of side walls and extend therebetween.

In another embodiment, the floor cleaning apparatus further comprises a handle and a grip slidably mounted to the handle. The grip is mechanically coupled to the actuation arrangement. In certain embodiments, the grip is mechanically coupled to the actuation arrangement such that movement of the grip relative to the handle in a first direction rotates the dispensing roller and the collection roller. In certain other embodiments, movement of the grip relative to the handle in a second direction opposite the first direction will not cause rotation of either of the dispensing roller and the collection roller.

In another aspect, embodiments of the present invention provide a cleaning apparatus that includes a roll arrangement and a one way mechanism permitting movement of the roll arrangement in a first rotational direction and preventing movement of the roll arrangement in a second rotational direction. A floor cleaning apparatus according to this embodiment includes a frame. A roll arrangement is carried by the frame and adapted to carry replaceable cleaning media thereon. The roll arrangement is mounted to the frame such that the cleaning media extends across a cleaning surface of the frame. A one way advancing mechanism is connected to the roll arrangement and adapted to rotate the roll arrangement to move the cleaning media across the cleaning support surface in a first direction and prevent movement of the cleaning media across the cleaning support surface in a second direction opposite the first direction.

In one embodiment, the roll arrangement includes a dispensing roller and a collection roller. The one way advancing mechanism mechanically couples the dispensing roller and the collection roller to rotate the dispensing and collection rollers in the first direction. In certain embodiments, the dispensing roller and collection roller rotate in the first direction simultaneously.

In another embodiment, the one way advancing mechanism includes a drive train and a follower mechanism. The drive train mechanically couples a drive shaft of the roll arrangement and the collection roller. The follower mechanism mechanically couples the collection roller and the dispensing roller. In certain embodiments, the drive train is connected to an input end of the drive shaft, and connected to an input end of the collection roller. The follower mechanism is connected to an output end of the collection roller and connected to an input end of the dispensing roller. In certain embodiments, the one way advancing mechanism is arranged to cycle the floor cleaning apparatus through a winding cycle and a return cycle. The drive train includes a drive gear, floating gear, linking gear, and collection roller input gear. In the winding cycle, the drive gear is in meshed contact with the floating gear, the linking gear is in meshed contact with the floating gear, and the collection roller input gear is in meshed contact with the linking gear. The drive gear and the floating gear are in meshed contact in the return cycle, and the floating gear is not in meshed contact with the linking gear in the return cycle.

In yet another aspect, embodiments of the invention provide a floor cleaning apparatus that incorporates a slidable grip allowing a user to easily transition or unwind cleaning media from a dispensing roll and collect the cleaning media on a collection roll. A floor cleaning apparatus according to this embodiment includes a frame. A handle is mounted to the frame. A first roller is mounted to the frame and adapted to carry a roll of cleaning media thereon. A second roller is also mounted to the frame and adapted to wind up the cleaning media from the first roller. A third roller is interposed between the first and second rollers and mechanically coupled to the second roller. A sliding grip is slidably coupled to the handle and mechanically coupled to the third roller. Movement of the sliding grip along the handle in a first direction causes the first and second rollers to rotate in a first rotational direction, and the third rollers to rotate in a second rotational direction opposite the first rotational. Movement of the sliding grip along the handle in a second direction opposite the first direction causes the third roller to rotate in a third rotational direction opposite the second rotational direction, with the first and second rollers remaining fixed relative to the third roller.

In another embodiment, the second and third rollers are mechanically connected via a drive train and the first and second rollers are mechanically connected via a follower mechanism. In certain embodiments, the drive train includes a pawl mechanism arranged to allow for the second roller to rotate in first rotational direction and prevent the second roller to rotate in a forth rotational direction opposite the first rotational direction.

In certain embodiments, the follower mechanism includes a breaking arrangement arranged to allow a follower belt of the follower mechanism to travel between a breaking element and a breaking pad of the breaking arrangement in a first linear direction. The breaking arrangement is arranged to prevent the follower belt to travel between the breaking element and the breaking pad in a second linear direction opposite the first linear direction. In certain embodiments, the breaking element compresses the follower belt against the breaking pad when the third roller rotates in a fifth rotational direction opposite the second rotational direction.

In another aspect, a floor cleaning apparatus is provided that automatically maintains the tension of cleaning media mounted thereon. An embodiment of such a floor cleaning apparatus includes a frame with a dispensing roller mounted to the frame and adapted to carry a roll of cleaning media thereon. The dispensing roller is operable to dispense cleaning media by rotating in a first rotational direction. A collection roller is also mounted to the frame and adapted to collect the cleaning media in a roll form once a portion of the cleaning media has transitioned across a cleaning surface of the frame positioned between the dispensing roller and the collection roller. A tensioning arrangement is mounted to the dispensing roller and is operable impart a tensioning force on the cleaning media by rotating the dispensing roller in a second rotational direction opposite the first direction.

In another aspect, a floor cleaning apparatus is provided that automatically maintains the tension of cleaning media mounted thereon. An embodiment of such a floor cleaning apparatus includes a frame and a dispensing roller mounted to the frame and adapted to carry a roll of cleaning media thereon, the dispensing roller operable to dispense cleaning media. A collection roller is also mounted to the frame and adapted to collect the cleaning media in a roll form once a portion of the cleaning media has transitioned across a cleaning surface of the frame positioned between the dispensing roller and the collection roller. The dispensing roller and collection roller are mechanically connected such the dispensing roller and collection roller simultaneously rotate a the first rotational direction. A one-way clutch is operably mounted between the dispensing roller and the collection roller. The one-way clutch is operable to rotate in the first rotational direction with the dispensing roller and the collection rollers and operable to permit the dispensing roller to rotate in a second rotational direction opposite the first rotational direction independently of the collection roller such that rotation of the dispensing roller in the second rotational direction does not result in rotation of the collection roller.

In another aspect, method of cleaning a flat surface using a cleaning apparatus carrying cleaning media thereon. Such a method includes dispensing clean cleaning media from a dispensing roller and simultaneously collecting soiled cleaning media onto a collection roller such that a span of clean cleaning media extends from the dispensing roller to the collection roller. The method also includes tensioning the span of clean cleaning media by recollecting a portion of the span of clean cleaning media onto the dispensing roller.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
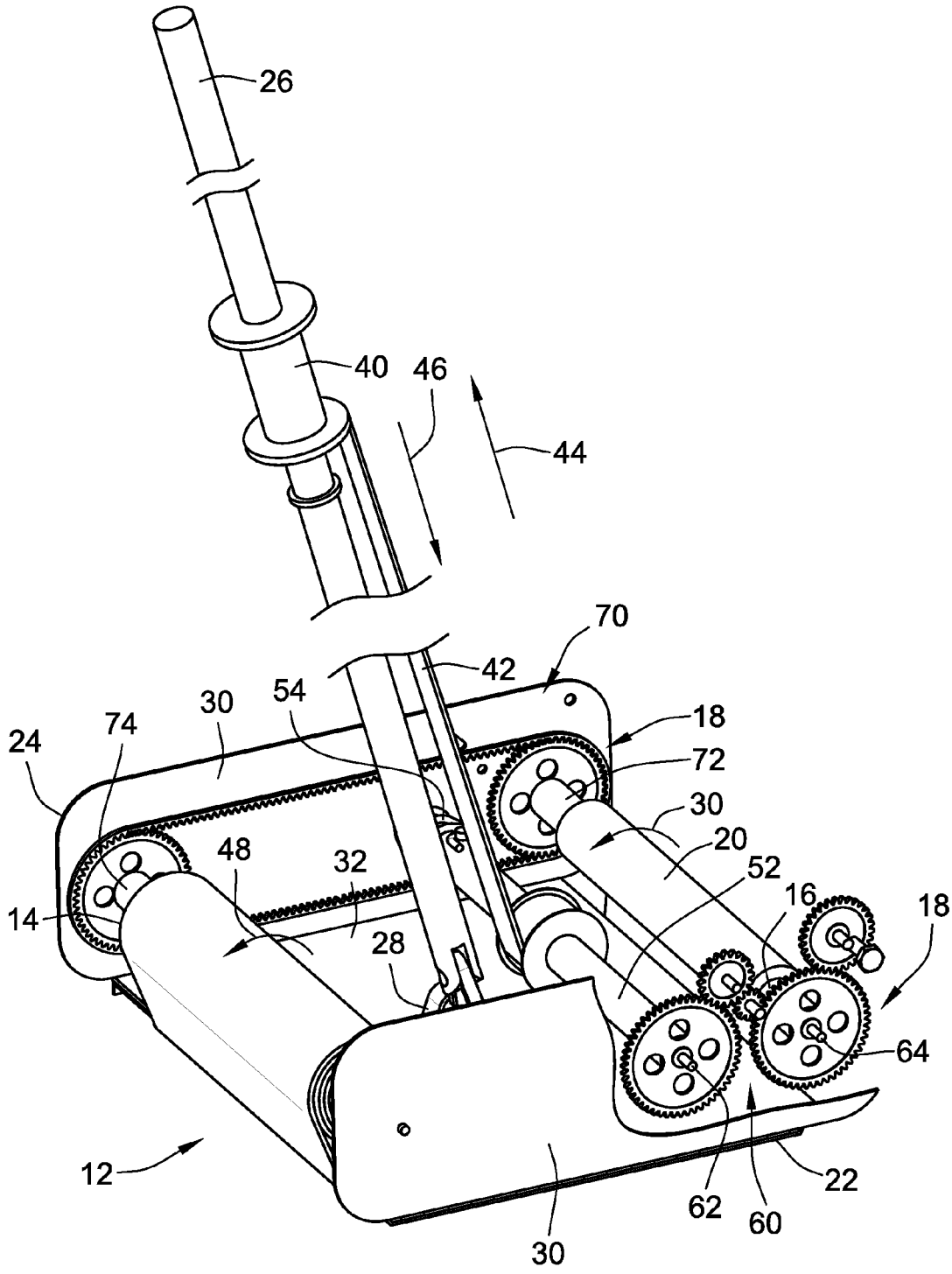
FIG. 1 is a perspective view of an exemplary embodiment of a floor cleaning apparatus according to the teachings of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, there is illustrated an exemplary embodiment of a floor cleaning apparatus 12 according to the teachings of the present invention. The floor cleaning apparatus 12 advantageously carries both unused and used portions of cleaning media 20 in roll form, so that the removal frequency of the cleaning media is generally minimized. Further, the floor cleaning apparatus 12 is designed to utilize "off-the-shelf" rolled cleaning media, e.g. paper towels and the like, to generally reduce cost. Still further, the floor cleaning apparatus 12 incorporates a handle 26 and a slidable grip 40 that allows a user to unwind unsoiled cleaning media 20 and wind soiled cleaning media 20 without bending over.

As will be described in greater detail by the following, the floor cleaning apparatus 12 includes a dispensing roller 14 and a collection roller 16. The dispensing roller 14 and collection roller 16 are mechanically coupled to one another by way of an actuation arrangement 18 in the form of a one-way mechanism. The actuation arrangement 18 is operable to simultaneously unwind cleaning media 20 from the dispensing roller 14 and wind soiled cleaning media 20 onto the collection roller 16.

As illustrated, the cleaning media 20 extends in a continuous span between the dispensing and collection rollers 14, 16 and across a cleaning surface 22. A span of the cleaning media 20 extending over the cleaning surface 22 is positioned between flooring or other hard surface and the cleaning surface 22. The actuation arrangement is operable to wind, i.e. advance, the span of cleaning media 20 from extending over the cleaning surface 22 to being wound upon the collection roller 16. As described herein, the above operation of the actuation arrangement 18 will be referred to in the following as a "winding cycle." After completion of the winding cycle, the actuation arrangement 18 will return to a ready position via a "return cycle."

The dispensing and collection rollers 14, 16, as well as the actuation arrangement 18 are mounted to a frame 24 of the floor cleaning apparatus 12. The frame 24 includes a pair of sidewalls 30 extending upward from a bottom wall 32 that defines the cleaning surface 22. The sidewalls 30 are generally used for mounting the dispensing and collection rollers 14, 16, as well as the various components of the actuation arrangement 18.

A handle 26 extends upward from the wall 32 to allow a user to bias the floor cleaning apparatus 12, and more particularly the cleaning surface 22 about a floor or other surface to clean the same. The handle 26 connects to the frame 24 via a universal joint 28. The universal joint 28 enhances the overall maneuverability of the floor cleaning apparatus 12.

Still referring to FIG. 1, the floor cleaning apparatus 12 includes a slidable grip 40 mechanically coupled to a drive shaft 52 of the actuation arrangement 18 via a belt 42. The slidable grip 40 is slidable along the handle 26 generally along directions 44, 46. Moving the slidable grip 40 along the handle 26 in direction 44 causes the cleaning media 20 to unwind from the dispensing roller 14 along rotational direction 48 while soiled collection media 20 is simultaneously wound along direction 50 about the collection roller 16 thus executing a winding cycle. As such, the dispensing roller 14 is generally a first roller, the collection roller 16 is generally a second roller, and the drive shaft 52 is generally a third roller, with these rollers forming a roller arrangement. Movement of the slidable grip 40 in direction 44 thus causes the first and second rollers to rotate in the same direction, and the third roller to rotate in a direction opposite the first and second rollers.

However, the slidable grip 40 is limited in this upward travel along the handle 24 in direction 44 by the unwound length of the belt 42. More specifically, once the belt 42 is unwound from the drive shaft 52 of the actuation arrangement 18, a biasing element 54 coupled to the drive shaft 52 of the actuation arrangement 18 is operable to rewind the belt 42 about the drive shaft 52 to return the slidable grip 40 to a ready position by moving the slidable grip 40 downward along the handle 26 in direction 46, thus executing the return cycle. As the belt 42 is rewound and the slidable grip 40 moves downward along direction 46, the dispensing and collection rollers 14, 16 do not wind or unwind the collection media 20.

The actuation arrangement 18 includes a drive train 60 in the form of a plurality of coplanar gears coupling an input end 62 of the drive shaft 52 to an input end 64 of the collection roller 16. The drive train 60 is thereby operable to transfer a torque of the drive shaft 52 to the collection roller 16 such that rotation of the drive shaft 52 results in rotation of the collection roller 16.

The actuation arrangement 18 also includes a follower mechanism 70. The follower mechanism is connected between an output end 72 of the collection roller 16 and an input end 74 of the dispensing roller 14. As such, the follower mechanism 70 is thereby operable to transfer a torque from the collection roller 16 to the dispensing roller 14. Accordingly, rotation of the drive shaft 52 imparts rotation to the collection roller 16 to wind the same in rotational direction 50. Rotation of the collection roller 16 in rotational direction 50 imparts rotation to the dispensing roller 14 in rotational direction 48 by way of the follower mechanism 70. The result of the above configuration is the simultaneous winding and unwinding of cleaning media 20 to exchange soiled cleaning media 20 extending across the cleaning surface 22 with unsoiled cleaning media 20 dispensed from the dispensing roller 14.

Figure 2:
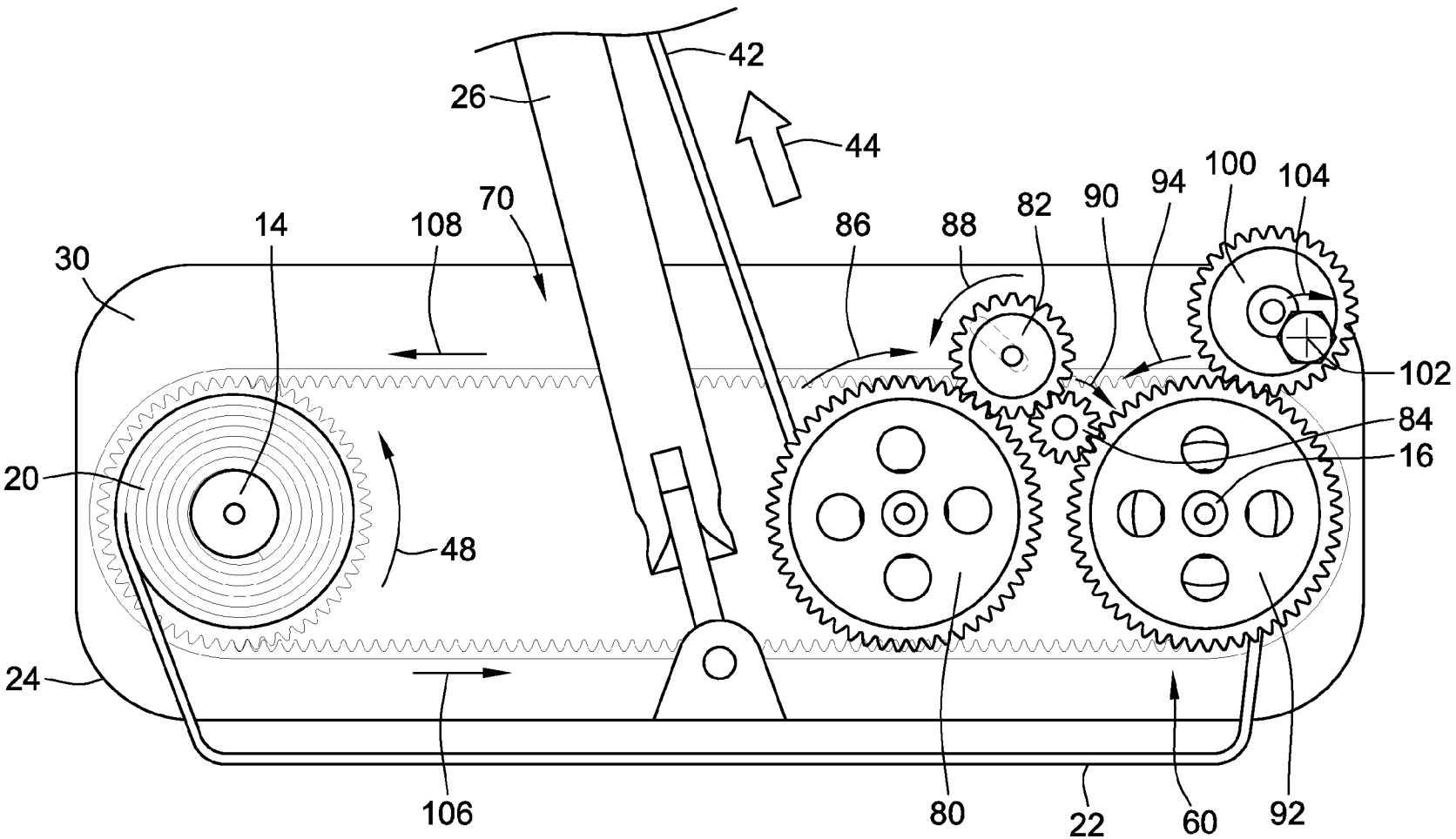
FIG. 2 is a side view of an actuation arrangement of the floor cleaning apparatus of FIG. 1, the actuation arrangement shown during a winding cycle of the floor cleaning apparatus.

Turning now to FIG. 2, the drive train 18 generally includes a plurality of gears mechanically coupling the drive shaft 52 to the collection roller 16. These gears include a drive gear 80 mounted for rotation with the drive shaft 52 at the input end 62 thereof. The drive gear 80 meshes with a floating gear 82. As the drive gear 80 rotates in direction 86 as a result of movement of the slidable grip 40 in direction 44 (see FIG. 1), the floating gear 82 will rotate in direction 88. As the floating gear 82 rotates in direction 88, a linking gear 84 meshing with the floating gear 82 will rotate in direction 90. As the linking gear 84 rotates in direction 90, a collection roller input gear 92 mounted for rotation with the collection roller 16 at the input end 64 thereof will rotate in direction 94.

The drive train 60 of the actuation arrangement 18 can also include a stop pawl in the form of a pawl gear 100. The pawl gear 100 is mounted to the frame 24 off of the center axis of the pawl gear and in a meshed contact with the collection roller input gear 92 to permit one way rotation of the collection roller input gear 92. More specifically, the pawl gear 100 will pivot about axis 102 in direction 104 to allow the collection roller input gear 92 to freely rotate in direction 94.

However, if the collection roller input gear 92 attempts to rotate in a direction opposite direction 94, the pawl gear 100 will prevent such rotation. This configuration advantageously ensures that as the floor cleaning apparatus 12 is moved forward, soiled cleaning media 20 will not be unwound from the collection roller 16. Although illustrated as a pawl gear 100, it will be recognized that various other pawl style mechanisms or elements can be utilized e.g. latches, pins, etc.

Figure 3:
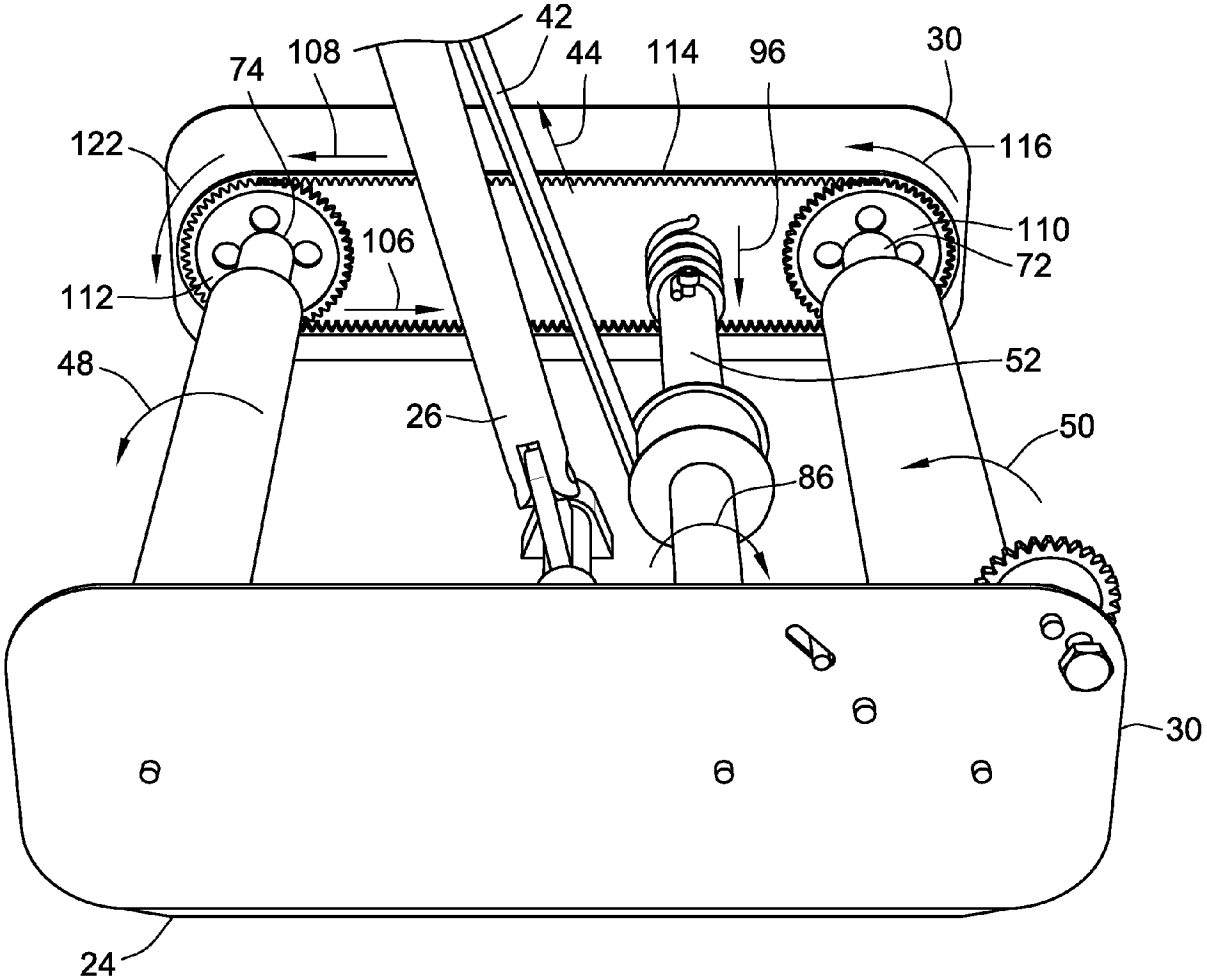
FIG. 3 is a partial perspective view of the floor cleaning apparatus of FIG. 1.

Turning now to FIG. 3, the follower mechanism 70 includes a collection roller output gear 110 mounted for rotation with the collection roller 16 at the output end 72 thereof. The follower mechanism 70 also includes a dispensing roller input gear 112 mounted for rotation with the dispensing roller 14 at the input end 74 thereof. The follower mechanism 70 also includes a follower belt 114 extending between the collection roller output gear 110 and dispensing roller input gear 112 such that rotation of the collection roller output gear 110 results in rotation of the dispensing roller input gear 112. Put another way, the dispensing roller 14 is slaved to the collection roller 16 by way of the follower mechanism 70.

Indeed, during the winding cycle, and as the collection roller 16 rotates in direction 48, the collection roller output gear 110 will rotate in direction 116, thereby causing the follower belt 114 to move in directions 106, 108 as illustrated. Movement of the follower belt 114 in directions 106, 108 will cause the dispensing roller input gear 112 to rotate in direction 122, thereby causing the dispensing roller 14 to rotate in direction 48 to dispense unused cleaning media 20 from the dispensing roller 14.

It will be recognized from the above that the drive train 60 and follower mechanism 70 ensure that the dispensing and collection rollers 14, 16 rotate simultaneously to move soiled cleaning media 20 across the cleaning surface 22 and onto the collection roller 16 while at the same time moving unsoiled collection media 20 onto the cleaning surface 22. The above described operation of the drive shaft 52, drive train 60 and follower mechanism 70 as well as the dispensing and collection rollers 14, 16 complete the winding cycle of the floor cleaning apparatus 12. Once complete, the biasing element 54 will rotate the drive shaft 52 to thereby cause the floor cleaning apparatus 12 to undergo a return cycle as described in the following.

More specifically, as the drive shaft 52 is rotated to unwind the belt 42 during the winding cycle, the biasing element 54 mounted to the frame 24 and drive shaft 54 as illustrated at FIG. 3 will elongate in direction 96. Once elongated, and the belt 42 is completely unwound, the biasing element 54 will rotate the drive shaft 52 to rewind the belt 42 until the biasing element 54 returns to its normal non-elongated length. Referring momentarily back to FIG. 1, the slidable grip 40 will move in direction 46 until it makes contact with a stop ring 98 located on the handle 26. The stop ring 98 is operable to prevent further movement of the slidable grip 40 along the handle 26 in direction 46.

Figure 4:
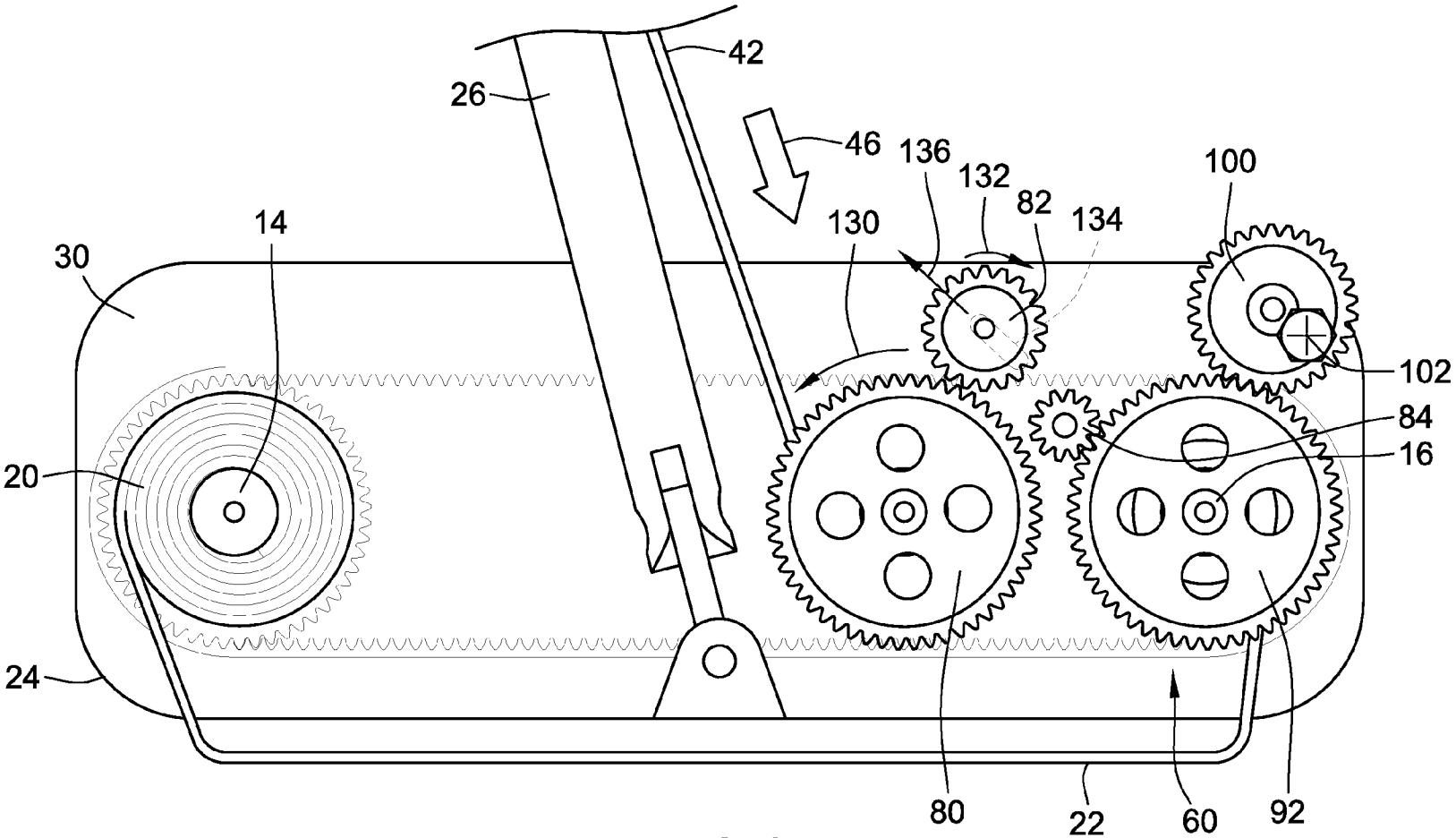
FIG. 4 is a side view of an actuation arrangement of the floor cleaning apparatus of FIG. 1, the actuation arrangement shown during a return cycle of the floor cleaning apparatus.

Turning now to FIG. 4, as the biasing element 54 returns to its non-elongated position, the drive gear 80 will rotate in direction 130 as illustrated. As the drive gear 80 rotates in direction 130, the floating gear 82 will rotate in direction 132. However, rotation of the drive gear 80 in direction 130 will also cause the floating gear 82 to move within a slot 134 such that the floating gear 82 no longer meshes with the linking gear 84.

Because the floating gear 82 no longer meshes with the linking gear 84, the linking gear 84 as well as the collection roller input gear 92 will not rotate. It will be recognized from the above that if the collection roller input gear 92 does not rotate, the collection roller 16 will not rotate. If the collection roller 16 does not rotate, the follower mechanism will not operate to cause rotation of the dispensing roller 14. As a result of the above operation, during the return cycle, the slidable grip 40 returns to a ready position, the belt 42 is rewound upon the drive shaft 52, and the floor cleaning apparatus 12 is then ready for another winding cycle.

Figure 5A:
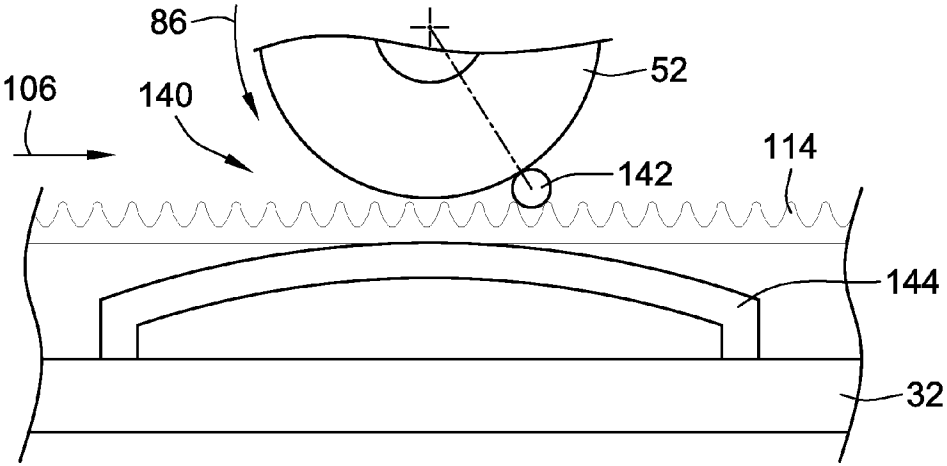
FIG. 5A-5B are partial side views of a braking arrangement of the floor cleaning apparatus of FIG. 1.
Figure 5B:
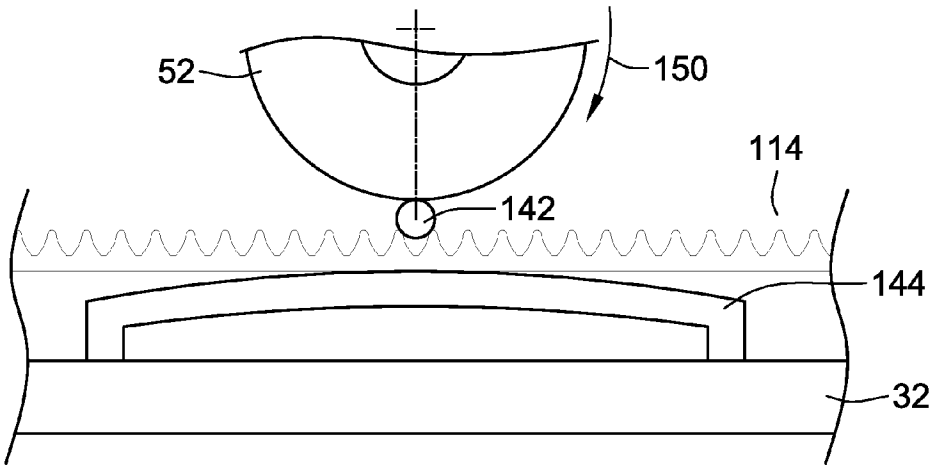

Referring now to FIGS. 5A-5B, and particularly FIG. 5A, the floor cleaning apparatus 12, and more particularly the follower mechanism 70 can also incorporate a braking arrangement 140. As will be more fully understood by the following, the braking arrangement 140 operates in conjunction with the pawl gear 100 described above to ensure that inadvertent unwinding of soiled cleaning media 20 from the collection roller 16 is minimized or avoided entirely. The breaking arrangement 140 includes a breaking element 142 positioned above the follower belt 114 and mounted to the drive shaft 52. The braking element 142 can be a pin, washer, or other mechanical element affixed to the drive shaft 52 to selectively exert a compressive force upon the follower belt 114 as described below. As illustrated, the braking element 142 is mounted on the drive shaft 52 off of the center axis thereof, but positioned to allow movement of the follower belt 114 in direction 106 during the winding cycle.

Referring now to FIG. 5B, the braking arrangement 140 also includes a resilient breaking pad 144 positioned below the braking element 142 and below the follower belt 114 as illustrated. From the mounting and operation of the drive train 60 and drive shaft 52 discussed above, it will be recognized that in the event the pawl gear 100 fails and the floating gear 84 fails to move within the slot 134 as described above, the drive shaft 52 will attempt to rotate in direction 150 as illustrated.

However, if the drive shaft 52 attempts to rotate in direction 150, the breaking element 142 will pinch the follower belt 114 against the breaking pad 144 to prevent further movement of the follower belt 114. By preventing such movement, the dispensing and collection rollers 14, 16 will not rotate and the likelihood that soiled cleaning media 20 will inadvertently unwind from the collection roller 16 will be minimized or avoided entirely.

Figure 6:
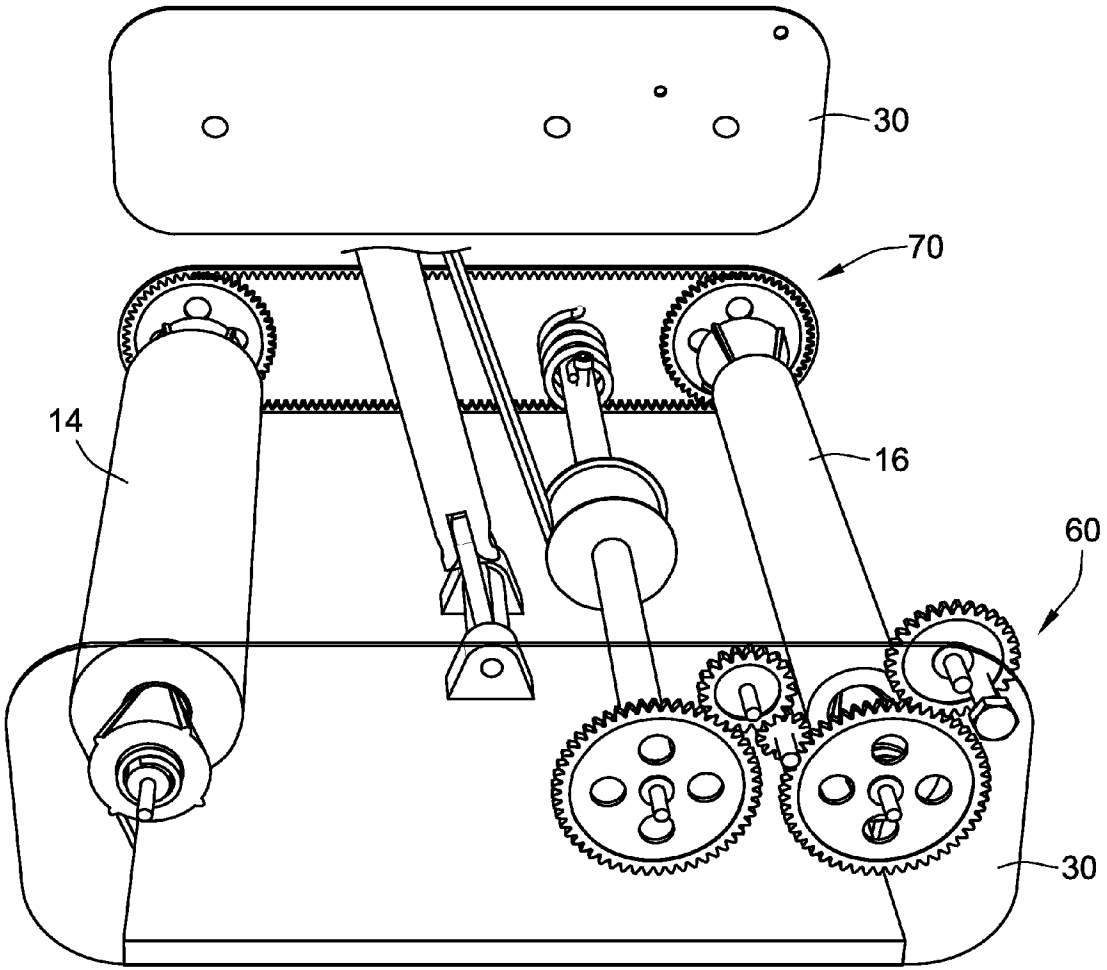
FIG. 6 is a partial exploded view of the floor cleaning apparatus of FIG. 1, showing a dispensing roller thereof in an exploded view.
Figure 6:
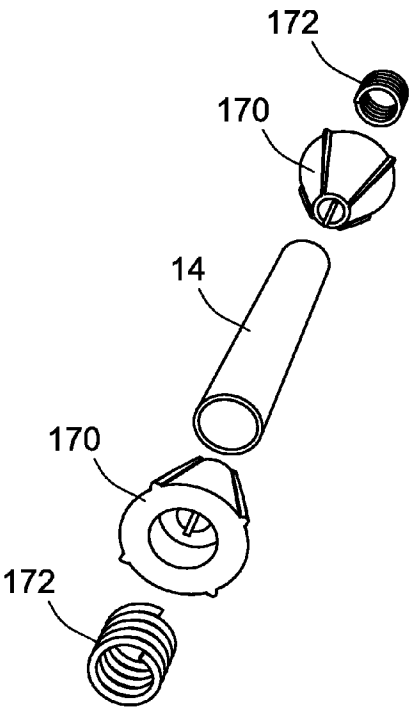

Turning now to FIG. 6, the dispensing and collection rollers 14, 16 can also each include pair of roller grips or grippers 170. Each pair of grippers 170 is spring loaded by way of a spring 172. The grippers 170 and springs 172 are operable to exert a compressive force on a core of the cleaning media 20 to ensure that the cleaning media 20 rotates with the dispensing and collection rollers 14, 16. A spring 172 may bias one or both of the grippers 170 each of the dispensing and collection rollers 14, 16 axially inward do thereby pinch a core of the cleaning media 20 relative to the dispensing and cleaning rolls 14, 16. The grippers 170 are mounted to each of the dispensing and collection rollers 14, 16 such that they rotate with the collection and dispensing rollers 14, 16.

Having described the various structural and functional attributes of the illustrated embodiment of FIGS. 1 through 6, the following describes the basic operation of the same.

To initially load cleaning media 20 onto the dispensing roller 14, the dispensing roller 14 is removed from the remainder of the frame 24 by removing a sidewall 30 thereof, or alternatively by removing the dispensing roller 14 from the frame 24 while leaving the frame 24 intact. A roll of cleaning media 20, e.g. a roll of paper towels, is then slid over the dispensing roller 14. The dispensing roller 14 is then placed back onto the frame 24 such that the cleaning media 20 is positioned between the grippers 170.

A blank cardboard core of a previously used roll of cleaning media is then positioned over the collection roller 16 in the same manner as described above relative to the dispensing roller 14. An unwound edge of the cleaning media 20 is then affixed to the blank core on the collection roller 16. The leading end of the cleaning media 20 may be affixed to the blank core using tape or another adhesive. Alternatively, the leading end of the cleaning media 20 may be adhered directly to the collection roller 16 without the use of a blank cardboard core. However, it will be recognized that using the blank cardboard core will facilitate the quick removal of soil cleaning media 20 from the collection roller 16. Once the leading end of the cleaning media 20 is affixed to the blank cardboard core, or alternatively directly affixed to the collection roller 16, the floor cleaning apparatus is ready for operation.

To operate the floor cleaning apparatus a user simply pushes the floor cleaning apparatus 12, and more particularly the cleaning surface 22 having a length of cleaning media 20 positioned over the cleaning surface 22, back and forth over flooring to collect dirt and other particles. Prior to moving the floor cleaning apparatus 12 over the flooring, the user can spray a cleaning solution upon the floor. The collection media 20 will collect the dirt or other particles, as well as the cleaning solution as it passes thereover.

Once the section of the cleaning media 20 extending over the cleaning surface 22 has collected a sufficient amount of dirt and/or used cleaning solution, the user can move the slidable grip 40 along the handle 26 in direction 44 to initiate a winding cycle. This will cause the used cleaning media 20 extending over the cleaning surface 22 to be wound upon the collection roller 16 and be replaced with an unused length of cleaning media 20 simultaneously unwound from the dispensing roller 14. Thereafter, a user can continue moving the floor cleaning apparatus 12 across the floor to continue cleaning, and repeat the wind cycle as needed.

Figure 7:
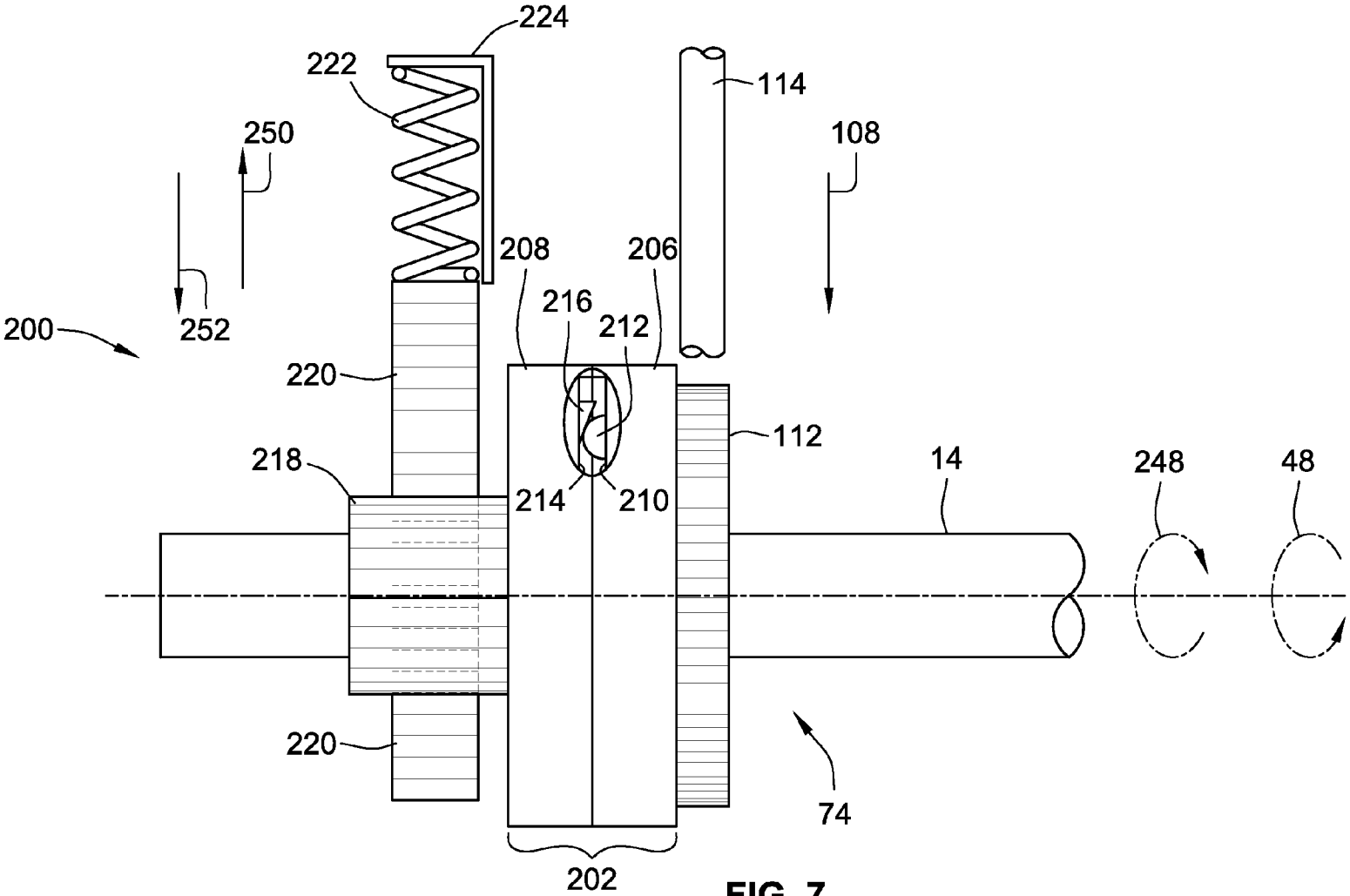
FIG. 7 is a partial top view of a tensioning arrangement of the floor cleaning apparatus of FIG. 1.
Figure 8:
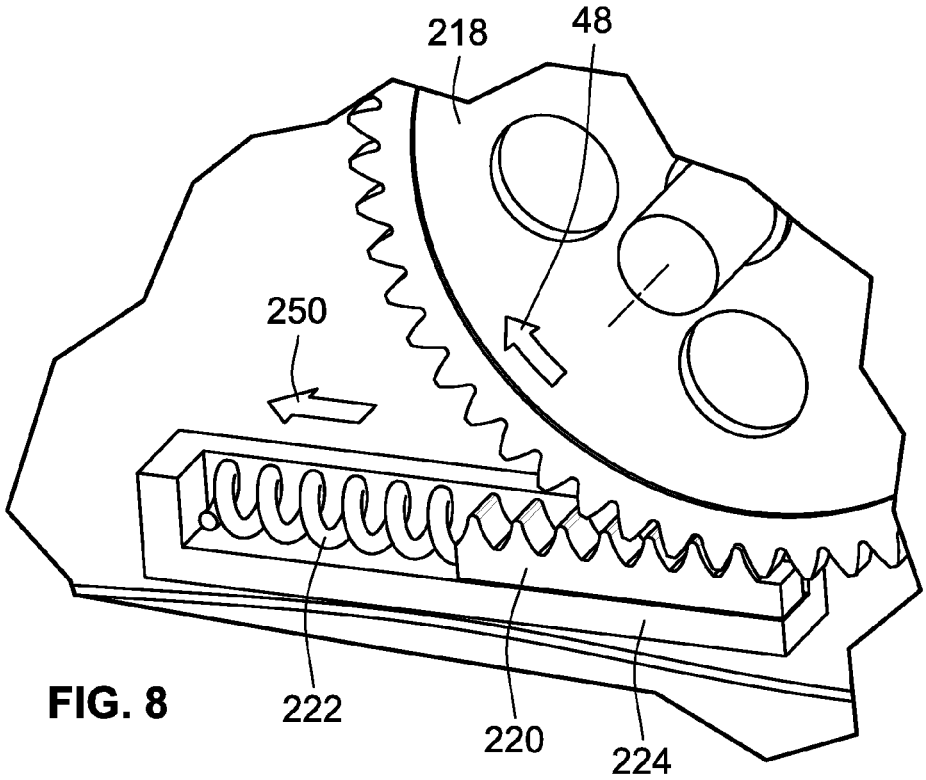
FIGS. 8-9 are partial perspective views of the tensioning arrangement of FIG. 7 in operation.
Figure 9:
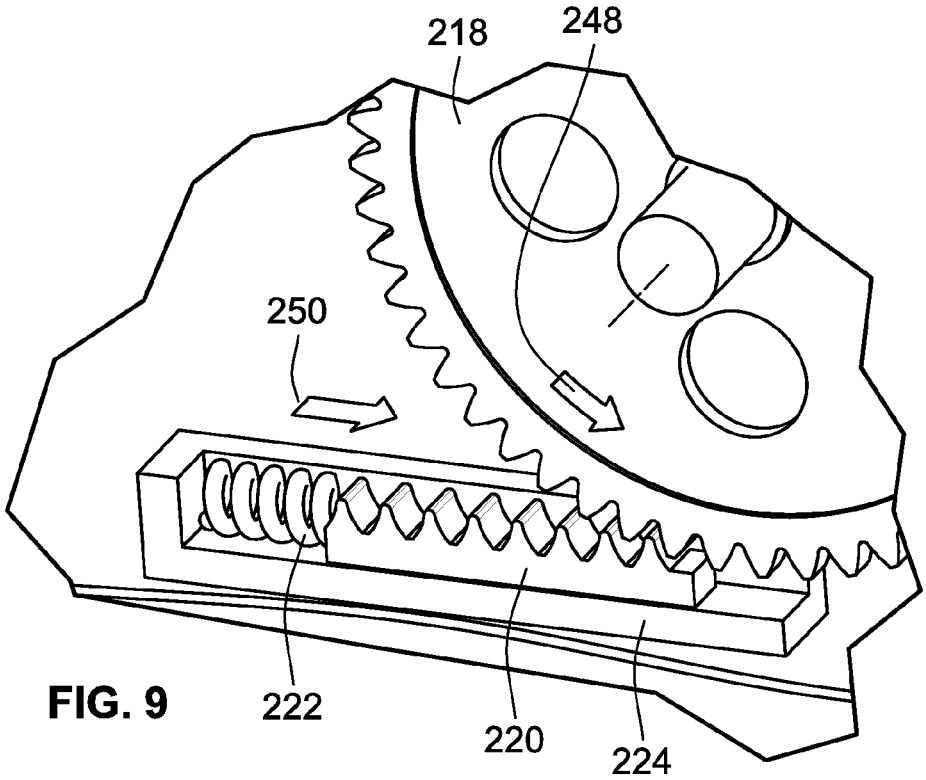

Turning now to FIGS. 7-9, an optional tensioning arrangement 200 is illustrated. The tensioning arrangement is situated proximate the input end 74 of the dispensing roller 14, and operable to allow cleaning media 20 to pay out from the dispensing roller 14 commensurate with the rotation of the collection roller 16 to achieve the winding operation described above. However, the tensioning arrangement 200 is also operable to wind up or take up the slack of the cleaning media 20 by rotating the dispensing roller 14 in direction 248 opposite the winding direction 48.

The tensioning arrangement includes a clutch 202 as well as a rack and pinion assembly 204 that work in concert to permit rotation of dispensing roller 14 in direction 248 independently of rotation of collection roller 16. Put differently, rotation of dispensing roller 14 does not result in a like rotation of collection roller 16, despite the fact that these rollers 14, 16 are coupled using follower belt 114.

The clutch 200 is a one-way clutch that includes first and second clutch members 206, 208 that are generally disc or plate like structures, and are each mounted to the dispensing roller 14. The clutch members 206, 208 are mounted to the dispensing roller 14 such that they may freely rotate on the collection roller 14. First clutch member 206 has an inner most axial surface 210 with a plurality of detents 212 protruding therefrom. Second clutch member 208 has an inner most axial surface 214 with a plurality of ramped structures 216 protruding therefrom.

Rack and pinion assembly 204 includes pinion 218 and rack 220. Rack 220 is spring loaded via connection to biasing member 222. Biasing member 222 is fixedly mounted to retainer 224 such that movement of rack 220 in direction 250 compresses biasing element 222. Upon compression, biasing element 222 is operable to return rack 220 by elongation of biasing element 222 in direction 252, as described below.

In the illustrated embodiment, input gear 112 and first and second clutch members 206, 208 are mounted to dispensing roller 14 such that they may freely rotate relative thereto. Pinion 218, however, is fixedly mounted to dispensing roller 14 such that the rotation of dispensing roller 14 necessarily implicates rotation of pinion 218. The aforementioned configuration permits the tensioning of the cleaning media 20, after it is has been paid out from the dispensing roller 14.

More specifically, as described above, movement of follower belt 114 in direction 108 causes input gear 112 to rotate in direction 48. Input gear 112 is fixed to first clutch member 206 such that first clutch member 206 rotates with input gear 112. This rotation causes detents 212 to abut the upright portion of ramped structures 216, and thus second clutch member 208 also rotates with first clutch member 206 and input gear 112 in direction 48.

Second clutch member 208 is fixed to pinion 218 such that rotation of second clutch member 208 results in rotation of pinion 218. As a result, pinion gear 218 also rotates with first and second clutch members 206, 208 and input gear 112 in direction 48. Turning now to FIG. 8, as pinion 218 rotates in direction 48, rack 222 moves within retainer 224 as illustrated to compress biasing element 222. Because pinion 218 is fixedly mounted to dispensing roller 14, dispensing roller 14 also rotates in direction 48, and simultaneously, unsoiled cleaning media 20 is paid out from dispensing roller 14, and soiled media 16 is taken up by collection roller 16 as described above.

Turning now to FIG. 9, upon completion of the compression of biasing element 222 and termination of movement in direction 48, biasing element 222 will then bias rack 220 in direction 252 as shown. This rotation causes pinion to rotate in direction 248, as well as second clutch member 208. However, and returning momentarily to FIG. 7, ramped structures 216 will move relative to detents 216 due to their ramped geometry. Second clutch member 208 has enough axial freedom relative to first clutch member 206 to back away from the same. As such, first clutch member 206 will not rotate, nor will input gear 112, and thus follower belt 114 will not move.

However, given that pinion 218 is nevertheless fixedly mounted to dispensing roller 14, the same will rotate in direction 248. This causes any slack in cleaning media 20 to be taken back up by dispensing roller 14, and thus a sufficient amount of tensioning is preserved in cleaning media 20. Other types of one-way clutches could be utilized in place of clutch 202 to achieve the same results, and thus the invention is not limited to the particular embodiment illustrated.

As described herein, the floor cleaning apparatus 12 overcomes prior designs by allowing a user to incorporate an off the shelf roll of cleaning media 20, e.g. paper towels, to clean a floor. The user can unwind soiled cleaning media from the dispensing roller 14 and simultaneously wind soiled cleaning media onto the collection roller 16 to insure that effective cleaning is accomplished. The floor cleaning apparatus 12 thus allows the user to use an entire roll of cleaning media for it is necessary to place the same. Further, the user can use any desired cleaning solution in combination with the cleaning media 20 and is not limited to pre-impregnated pads or the like.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A manual floor cleaning apparatus, comprising:

a frame;

a dispensing roller mounted to the frame and adapted to carry a roll of cleaning media thereon, the dispensing roller operable to dispense cleaning media by rotating in a first rotational direction;

a collection roller mounted to the frame and adapted to collect the cleaning media in a roll form once a portion of the cleaning media has transitioned across a cleaning surface of the frame positioned between the dispensing roller and the collection roller;

a tensioning arrangement mounted to the dispensing roller and operable impart a tensioning force on the cleaning media by rotating he dispensing roller in a second rotational direction opposite the first direction;

wherein the tensioning arrangement comprises a one-way clutch;

wherein the one-way clutch includes first and second clutch members which are mounted to the dispensing roller such that they may freely rotate relative thereto;

wherein the first clutch member includes a plurality of detents, and the second clutch member includes a plurality of ramped structures, the plurality of detents, and the second plurality of ramped structures such that both the first and second clutch members rotate in the first rotational direction with the dispensing roller; and further comprising a rack and a pinion, the pinion fixedly mounted to the second clutch member for rotation with the second clutch member such that the pinion rotates in the first rotational direction with the first and second clutch members to move the rack in a linear first direction, wherein movement of the rack in the linear first direction compresses a biasing element operably connected to an end of the rack.

2. The floor cleaning apparatus of claim 1, wherein the biasing element moves the rack in a second linear direction to rotate the pinion in the second direction.

3. The floor cleaning apparatus of claim 2, wherein the pinion is fixedly mounted to the dispensing roller.

4. A manual floor cleaning apparatus, comprising:

a frame;

a dispensing roller mounted to the frame and adapted to carry a roll of cleaning media thereon, the dispensing roller operable to dispense cleaning media;

a collection roller mounted to the frame and adapted to collect the cleaning media in a roll form once a portion of the cleaning media has transitioned across a cleaning surface of the frame positioned between the dispensing roller and the collection roller;

wherein the dispensing roller and collection roller are mechanically connected such the dispensing roller and collection roller simultaneously rotate in a first rotational direction;

a one-way clutch operable mounted between the dispensing roller and the collection roller, the one-way clutch operable to rotate in the first rotational direction with the dispensing roller and the collection rollers and operable to permit the dispensing roller to rotate in a second rotational direction opposite the first rotational direction independently of the collection roller such that rotation of the dispensing roller in the second rotational direction does not result in rotation of the collection roller;

wherein the one-way clutch comprises first and second clutch members mounted to the dispensing roller such that the first and second clutch members can rotate relative to the dispensing roller; and further comprising a rack, a pinion, and a biasing element, the pinion fixedly mounted for rotation with the dispensing roller, the rack in meshed contact with the pinion, the biasing element mounted to the pinion and to a retainer such that movement of the rack in a first linear direction compresses the biasing element.

5. The floor cleaning apparatus of claim 4, further comprising an input gear mounted to the dispensing roller and an output gear mounted to the collection roller, wherein a follower belt mechanically couples the input and output gears such that rotation of the output gear results in rotation of the input gear.

6. The floor cleaning apparatus of claim 5, wherein the input gear is fixedly mounted to the first clutch member such that rotation of the first clutch member in the first rotational direction results in rotation of the input gear in the first rotational direction.

7. The floor cleaning apparatus of claim 6, wherein second clutch member rotates relative to the first clutch member in the second rotational direction such that the first clutch member does not rotate in the second rotational direction.

8. The floor cleaning apparatus of claim 7, wherein input gear does not rotate in the second rotational direction.

* * * * *